United States Patent [19]

Rose

[11] 4,213,495

[45] Jul. 22, 1980

[54] INVESTMENT CASTING METHOD

[75] Inventor: Stanley E. Rose, Phoenix, Ariz.

[73] Assignee: Ceram-Dent, Inc., Phoenix, Ariz.

[21] Appl. No.: 938,460

[22] Filed: Aug. 31, 1978

[51] Int. Cl.[3] ..... B22C 9/04

[52] U.S. Cl. ..... 164/34; 164/35

[58] Field of Search ..... 164/34, 35, 23, 24, 164/25, 26, 246, DIG. 15; 264/221, 317, 219, 17, 19, 225; 432/24, 25, 220, 258; 13/31

[56] References Cited

U.S. PATENT DOCUMENTS

| | | | |
|---|---|---|---|
| 3,403,212 | 9/1968 | Sato | 13/31 |
| 3,610,317 | 10/1971 | Benfield | 164/35 |
| 3,741,718 | 6/1973 | Boyer et al. | 13/31 |
| 3,775,043 | 11/1973 | Johansson et al. | 13/31 |
| 4,113,426 | 9/1978 | Rogers | 432/25 |

FOREIGN PATENT DOCUMENTS

| | | | |
|---|---|---|---|
| 1169977 | 5/1964 | Fed. Rep. of Germany | 432/24 |
| 2140433 | 2/1973 | Fed. Rep. of Germany | 432/25 |
| 2329261 | 1/1974 | Fed. Rep. of Germany | 432/24 |
| 457865 | 2/1975 | U.S.S.R. | 432/25 |

*Primary Examiner*—Robert D. Baldwin
*Assistant Examiner*—K. Y. Lin
*Attorney, Agent, or Firm*—Cahill, Sutton & Thomas

[57] ABSTRACT

An improved method incorporating investment burn out at a predetermined ideal temperature. The investment encasing the wax-like model of the desired casting is placed in an oven preheated to an ideal burn out temperature. The oven is maintained at that temperature while the pressure in the oven is increased to a predetermined pressure and maintained at that pressure for a given time. Following that time, the pressure is cycled between the predetermined pressure and atmospheric pressure or below for a second predetermined time.

10 Claims, 1 Drawing Figure

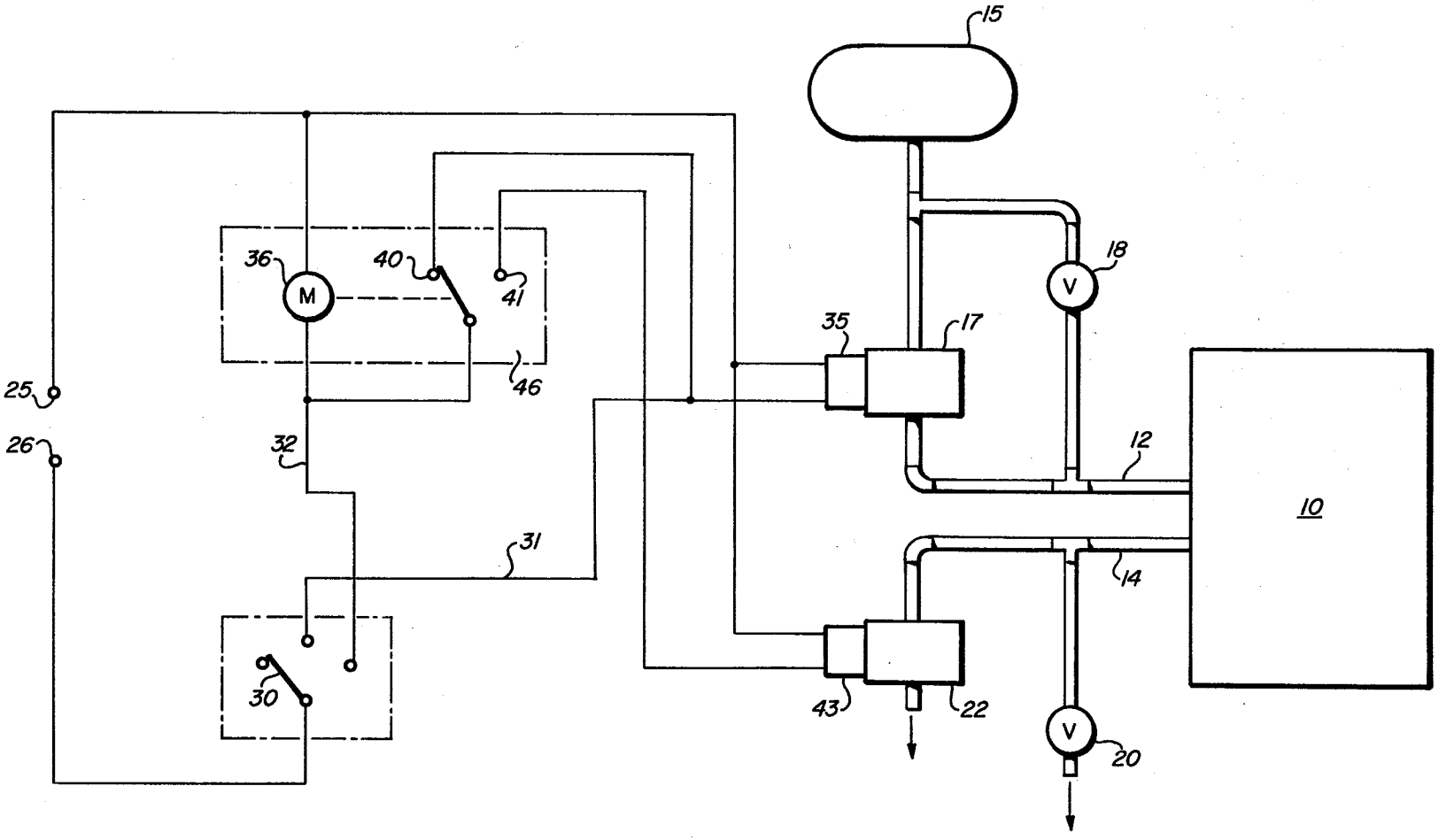
10
12
14
15
17
18
20
22
25
26
30
31
32
35
36
40
41
43
46
M

INVESTMENT CASTING METHOD

The present invention relates to investment casting, and more particularly to an improved method for use during the burn out phase of investment casting procedures.

Investment casting of small precision parts usually entails careful monitoring of the investment procedure. For example, casting techniques used for producing cast metal parts for use in dental work such as caps for crown and bridge restorations, requires great care to insure that the cast part very accurately fits the tooth which has been prepared to receive the cap. Typically, a mold is taken of the tooth to which the cap is to be applied and a wax-like model of the metallic portion of the cap is made. The fit between the metal, which may be gold, non-precious metal, or a proprietary alloy, must precisely fit the tooth. Therefore, the wax-like model (containing the negative of the surfaces of the tooth) must be used in a process to precisely form metal surfaces corresponding to the supporting surfaces of the tooth.

These wax-like models provide the starting point for an investment casting process of a type that can be improved by the method of the present invention. These wax-like models are supported on wax sprues from a wax base; the model, sprue, and base are then placed in a cylindrical paper, cardboard, or metal tube commonly referred to as a casting ring. A variety of investing materials may be used in the process, each typically formed from a fine powder-like base mixed with a water or other liquid to form a pourable, liquified, slurry-like material which is then poured into the casting ring to immerse and cover the model and sprue. The liquified material solidifies (usually at room temperature) to form a green (unfired) investment with the model and sprue encased therein and with the wax base extending outwardly from the bottom thereof. The paper or cardboard ring is removed leaving a cylindrical investment that must now be subjected to a "burn out" step to both remove the wax-like materials within the investment and to harden the investment so that it can withstand the molten metal that ultimately will be poured into the cavities left by the wax-like model, sprue and base.

The burn out step generally takes the form of placing the green investment in an oven or furnace slowly bringing it up to temperature and "baking" the investment for a predetermined time at a given temperature. The temperature and time will vary depending on the investment material that is used. The burn out step is usually a very time consuming step in the investment casting procedure, and frequently requires two to three hours for small investments of the type used for dental applications. In addition to the inefficiencies caused by the required time (thus tieing up the time of an oven), the power consumed at the high temperatures and long times represents an additional inefficiency and expense.

It is therefore an object of the present invention to provide an improved investment casting method wherein the time for the burn out step is greatly reduced.

It is another object of the present invention to provide an improved investment casting method wherein the resulting cast part is precisely formed while greatly reducing the time required to produce the investment.

It is still another object of the present invention to provide an improved investment casting method wherein the power consumed for the production of the investment has been greatly reduced.

It is yet another object of the present invention to provide an improved investment casting method wherein the quality of the investments can be improved while nevertheless being produced more efficiently.

These and other objects of the present invention will become apparent to those skilled in the art as the description thereof proceeds.

Briefly, in accordance with the embodiment chosen for description, a green investment is formed by pouring a liquified investment material into a casting ring containing a wax-like model of the part to be cast. The liquified material is permitted to solidify at room temperature; the casting ring (if paper or cardboard) is then removed and the investment is ready for the burn out step.

The investment material is designed for a particular ideal burn out temperature. An oven is preheated to this ideal temperature and the green investment is placed therein. The pressure within the oven is increased and maintained for a first predetermined period of time. After the expiration of that time, the pressure within the oven is cycled between atmospheric pressure or below and the predetermined pressure. The cycling is continued for a second predetermined time. The investment is removed from the oven and the casting procedure is then completed.

The present invention may more readily be described by reference to the accompanying drawing showing a schematic representation of an investment furnace or oven and the controls.

The present invention will be described in terms of investment casting for use in precision dental applications; however, the method has equal applicability to other investment casting applications wherein precision parts, and particularly small parts such as jewelry, are to be produced.

Referring now to the drawing, a schematic control system for implementing the method of the present invention is shown. An oven 10 is provided for receiving and retaining investments during burn out. The oven is electrically powered (the circuit is not shown) and incorporates means for adjusting the temperature to a selected value. An air inlet tube 12 and an air outlet tube 14 are connected to the oven 10 and supply the interior thereof with air under pressure as will be described hereinafter. A pressurized air source 15 is connected through a solenoid valve 17 to the air input tube 12. Similarly, a manual valve 18 may be connected in parallel to the solenoid valve 17. The exhaust tube 14 is connected through manual valve 20 to permit the pressurized air within the oven 10 to be exhausted to the atmosphere. Similarly, a solenoid valve 22 is connected to the exhaust tube 14 for exhausting air to the atmosphere.

Terminals 25 and 26 may be connected to a conventional 110 volt power supply. Power from these terminals is applied through switch 30 to conductor 31 or conductor 32. When the switch 30 is placed so as to apply power to conductor 31, the solenoid 35 of solenoid valve 17 is energized. When switch 30 is placed so as to energize conductor 32, a timing motor 36 is energized which alternately closes contacts 40 and 41. When contact 40 is in the closed position, solenoid 35 is energized; when contact 41 is closed, solenoid 43 is energized thus actuating solenoid valve 22. The timing mechanism shown at 46 for cycling or alternately energizing solenoid valves 17 and 22 may also be used to energize and thus operate the switch 30. While the switch 30 is shown as a manual selection switch, interconnection can readily be made to provide automatic operation of the switch 30.

Investment casting is a relatively well known art; a great deal has been published concerning the techniques of the art as it applies to precision casting such as in dental applications. For example, such publications as the Howmedica, Inc. publication of June 1975 entitled, *Luxene ®Aleco ®, Non-Precious Casting Alloy Compendium* describes the general technique utilized in the prior art for investment casting metal parts to be used in crown and bridge restorations. Typically, a wax model of the part to be cast is mounted with sprues and base in a paper-like investment ring. A powder-like material is then mixed with water or other liquid to form a slurry-like material that is poured into the ring to immerse and cover the wax like model. A variety of commercial investment materials are available, each of which has its own particular advantages; however, the investment materials generally have a most advantageous burn out temperature or ideal temperature which should be used during the burn out step of the investing procedure. Some investment materials provide the operator with a selection of temperatures; however, usually one temperature is selected and used during the burn out.

The metals that may be used in the casting procedure will depend, of course, on the ultimate application of the part. Within the dental industry, there are a number of alloys that are available for use in investment casting procedures. Various alloys of gold, silver, platinum, palladium, as well as various proprietary non-precious metals, may be used. The particular metal that is to be used must generally be matched with the investment material since the respective alloys require different temperatures for casting and have different physical properties.

been modified so that it could be clamped shut to maintain an air seal. The pressure was then raised to 65 psig. This pressure was maintained for 4 minutes; the furnace was then exhausted and the pressure within the furnace was then cycled from atmospheric pressure to 65 psig for a period of 11 minutes. The cycling phase consisted of pressurizing the furnace by energizing the solenoid valve 17 and admitting the air pressure from source 15 to the furnace; the pressurizing cycle required approximately 9 seconds. The solenoid valve 22 is then energized and the solenoid valve 17 de-energized. The pressure within the furnace 10 was thus exhausted to atmosphere for approximately 6 seconds. As mentioned above, the cycling continued for a period of 11 minutes.

To produce the same investment using a typical prior art method, the furnace or oven would have been preheated to 600° F. The investment would then be inserted in the oven and preheated for a period of 10 minutes. The control on the furnace would then be raised from 600° F. to 1500° F. and the temperature permitted to rise. It would normally require approximately 40 minutes to reach 1500° F. The investment would then remain in the furnace for an additional 75 minutes at 1500° F. Thus, a total time of 125 minutes would normally be required to produce the completed investment.

By comparison, the investment in the above example was completed within a total time of 15 minutes, or approximately 12 percent of the time previously needed by the prior art technique. A comparison of parts cast by the investment formed by the present method with the investment formed by the prior art method indicated that the new investment provided better definition and fewer flaws than the old investment.

The above example was repeated for various investment ring sizes and the resulting investments were compared to the corresponding investments produced by prior art techniques. The following table summarizes the temperature and times during the burn out step of the prior art and present technique.

TYPICAL INVESTMENT BURN OUT TIMES IN MINUTES FOR ALECO ®NON-PRECIOUS CASTING ALLOY (ACA)

| | Prior Art Burn Out Times | | | | New Burn Out Times | | | |
|---|---|---|---|---|---|---|---|---|
| Casting Ring Dia. in. | Pre-heat at 600° F. | Raise to Burn out Temp. | Burn out at 1500° F. | Total Time | Pressure | Cycle | Total Time | New Time % of Old time |
| 1¼ | 10 | 40 | 75 | 125 | 4 | 11 | 15 | 12 |
| 1½ | 10 | 40 | 90 | 140 | 5 | 12 | 17 | 12 |
| 1¾ | 10 | 40 | 90 | 140 | 6 | 14 | 20 | 14 |
| 2 | 10 | 40 | 120 | 170 | 7 | 15 | 22 | 13 |
| 2½ | 10 | 40 | 150 | 200 | 8 | 17 | 25 | 13 |

EXAMPLE

A wax model together with a sprue and base were mounted within a casting ring having a 1¼ inch diameter. A liquified slurry of investment material was prepared and was poured into the ring to cover and immerse the sample. The investment material chosen for this particular application is known by the trademark Ceramigold, manufactured by the Whip-Mix Corporation. The particular burn out temperature chosen for this material was 1500° F. The investment was permitted to solidify at room temperature. The investment, approximately 1¼ inches in diameter and 3 inches in height was then removed from the investment ring and placed in a Thermolyne furnace that had been preheated to a temperature of 1500° F. The furnace had In some instances, the prior art techniques eliminate the preheating phase wherein the investment is placed in the furnace at 600° F. and the temperature was immediately adjusted so that the furnace would reach 1500° F. However, the elimination of the original 10 minute preheat phase results in a greater time required to reach the 1500° F. burn out temperature. It may be noted that care must be taken in the prior art technique not to cause thermal shock to the green investment by inserting the investment directly in a 1500° F. furnace. The latter action can frequently result in cracked or defective investments which become dangerous when molten metal is forced therein under pressure caused by centrifugal action in a centrifuge. It is believed that the initial pressurization of the furnace in the improved method inhibits the destructive effects of thermal shock.

The pressures used in the method of the present invention can range from 20 to 300 psig although the range from 40 to 120 psig is preferred. The initial burn out time immediately following the placement of the investment in the furnace can vary from 2 to 25 minutes although 3 to 10 minutes have been found to be adequate for smaller investments. Cycling of the pressure for a time from 2 to 75 minutes appears to achieve the desired burn out; however, lower cycling times may require higher pressures while longer cycling times become inefficient and mitigate the advantages to be achieved by the present method over the prior art. Cycle times of from 10 to 25 minutes appear ideal. The rate of pressurization and rate of exhaust times may result in explosion in view of the fact that there will exist a sharp pressure gradient from the inside to the outside of the investment; similarly, the use of very high pressures or extremely fast pressure rise times may even result in the implosion of the investment. Pressure rise times and exhaust times of from 5 to 15 seconds have been found to be satisfactory. The ratio of the time periods for maintaining the pressure steady within the furnace during the initial burn out period, and the cycling of the pressure within the furnace can vary. However, it has been found that in investment casting of small parts such as in dental applications, the time for cycling should be related to the time required for the initial burn out period in a ratio from 1 to 0.5, up to a ratio of 1 to 6.

The use of a negative pressure during the cycling phase may provide additional efficiencies and produce a time reduction in the overall time required for the investment burn out. For example, instead of cycling the pressure between atmospheric and some predetermined pressure above atmosphere, the cycling may take place between atmospheric pressure and a negative pressure. When using the latter technique, care must be taken not to reduce the pressure too rapidly so as to cause cracking or damage to the investment. Similarly, the cycling may occur between a positive and a negative pressure such that the pressure within the furnace passes through atmospheric during each cycle. However, availability of equipment in small investment casting laboratories may not be readily adapted to the requirements for cycling to and from negative pressures. Positive pressures, such as those described in the preceding example, are attained by equipment which is almost universally present in such casting labs and usually takes the form of a conventional electric motor-driven air compressor with an accumulator tank.

The method of the present invention has been found to produce investments, the characteristics of which are more readily controlled and the quality of which is equal to or usually better than the same investments manufactured by the prior art method. The time to produce the investments is drastically reduced therefore greatly increasing the productivity of each furnace while greatly reducing the power consumption per investment. A view of the above table indicates the drastically reduced times required to produce the investments; further, the above table does not take into account the additional time required in the prior art to cool the furnace from 1500° F., at the end of an investment burn out, to 600° F. in preparation to receive the next investment.

I claim:

1. A method for burn out of a green investment having an ideal burn out temperature and including a disposable pattern therein, said method comprising the steps of:

(a) heating an oven for receiving the green investment to the ideal burn out temperature;

(b) inserting the green investment within the oven at an ambient pressure;

(c) pressurizing the oven to a first predetermined pressure while maintaining the temperature of the oven at the ideal burn out temperature;

(d) maintaining the oven at the first predetermined pressure and at the ideal burn out temperature for a first predetermined time;

(e) cycling the pressure in the oven between the first predetermined pressure and a second predetermined pressure, which second predetermined pressure is less than the first predetermined pressure by an amount of at least 20 psig, and while maintaining the oven at the ideal burn out temperature for a second predetermined time; and (f) bringing the pressure within the oven to ambient pressure and removing the investment from the oven.

2. The method as set forth in claim 1 wherein the first predetermined pressure is in the range of 20 to 300 psig.

3. The method as set forth in claim 2 wherein the first predetermined pressure is in the range of 40 to 120 psig.

4. The method as set forth in claim 1 wherein the first predetermined time is in the range of 2 to 25 minutes.

5. The method as set forth in claim 4 wherein the first predetermined time is in the range of 3 to 10 minutes.

6. The method as set forth in claim 1 wherein the second predetermined time is in the range of 2 to 75 minutes.

7. The method as set forth in claim 6 wherein the second predetermined time is in the range of 10 to 25 minutes.

8. The method as set forth in claim 1 wherein the first predetermined pressure is in the range of 20 to 300 psig, the first predetermined time is in the range of 2 to 25 minutes, and the second predetermined time is in the range of 2 to 75 minutes.

9. The method as set forth in claim 1 wherein the pressure rise and pressure drop time may each be in the range of 5 to 15 seconds.

10. The method as set forth in claim 1 wherein the ratio of the first predetermined time to the second predetermined time is in the range of 1 to 0.5 to 1 to 5.

* * * * *